US006079575A

United States Patent [19]

Wang

[11] Patent Number: 6,079,575

[45] Date of Patent: Jun. 27, 2000

[54] MULTILAYERED RACK ASSEMBLY

[76] Inventor: Chang Chou Wang, 62, Lane 627, Sec. 7, Er Chi Rd., Er Lin Township, Changhua, Taiwan

[21] Appl. No.: 09/233,453

[22] Filed: Jan. 20, 1999

[51] Int. Cl.[7] ..... A47F 5/14; A47B 9/08

[52] U.S. Cl. ..... 211/187; 211/181.1; 108/110; 108/147.13

[58] Field of Search ..... 211/187, 181.1, 211/147.13, 147.15, 147.12, 188; 108/147.12, 147.13, 147.15, 144.11, 106, 107, 110, 134

[56] References Cited

U.S. PATENT DOCUMENTS

| | | | |
|---|---|---|---|
| 2,150,495 | 3/1939 | Beckwith | 211/182 |
| 2,894,643 | 7/1959 | Maslow | 108/106 |
| 2,919,816 | 1/1960 | Maslow | 211/182 |
| 2,970,702 | 2/1961 | Maslow | 108/106 |
| 3,208,406 | 9/1965 | Maslow | 108/106 |
| 3,306,466 | 2/1967 | Liston | 108/147.13 |
| 3,664,274 | 5/1972 | Bustos | 108/147.13 |
| 3,757,705 | 9/1973 | Maslow | 108/147.13 |
| 4,079,678 | 3/1978 | Champagne | 108/147.12 |
| 4,180,003 | 12/1979 | Clement | 108/147.13 |
| 4,444,125 | 4/1984 | Welsch et al. | 108/147.13 |
| 4,595,107 | 6/1986 | Welsch | 108/147.13 |
| 4,656,952 | 4/1987 | Schweizer | 108/147.13 |
| 4,750,626 | 6/1988 | Nicely | 211/187 |
| 4,763,799 | 8/1988 | Cohn et al. | 108/147.13 |
| 4,811,670 | 3/1989 | Kolvites et al. | 108/147.13 |
| 4,852,501 | 8/1989 | Olson et al. | 108/147.13 |
| 5,221,014 | 6/1993 | Welsch et al. | 211/187 |
| 5,303,645 | 4/1994 | Meacham | 108/144.11 |
| 5,326,062 | 7/1994 | Remmers | 211/181.1 |
| 5,390,803 | 2/1995 | McAllister | 211/187 X |
| 5,531,167 | 7/1996 | Stevens et al. | 108/147.13 |
| 5,676,263 | 10/1997 | Chang | 211/187 |
| 5,695,078 | 12/1997 | Otema | 211/187 |
| 5,803,277 | 9/1998 | Alvarez-Momoitio | 211/188 |
| 5,833,084 | 11/1998 | Chang | 211/187 |
| 5,884,567 | 3/1999 | Bartz, Jr. | 108/106 |

*Primary Examiner*—Daniel P. Stodola
*Assistant Examiner*—Jennifer E. Novosad
*Attorney, Agent, or Firm*—Bacon & Thomas

[57] ABSTRACT

A multilayered rack is composed of four upright rods and a plurality of shelves. The upright rods are provided in the outer wall thereof with a plurality of circular grooves arranged at spaced interval. The shelves are each provided at four corners thereof with a retaining ring and two arcuate pieces, each piece having a locating rib. The shelves are each provided at four corners thereof with two insertion segments and a cross rod. The retaining ring has a fastening block which is provided with two insertion holes for receiving the insertion segments, a concealing portion, and an inverted hook for engaging the cross rod. The shelves are fastened with the upright rods such that the locating ribs of the arcuate pieces of the retaining ring of the shelves are retained in one of the circular grooves of the upright rods.

3 Claims, 12 Drawing Sheets

MULTILAYERED RACK ASSEMBLY

FIELD OF THE INVENTION

The present invention relates generally to a rack, and more particularly to a multilayered rack assembly.

BACKGROUND OF THE INVENTION

As shown in FIG. 1, a multilayered rack A of the prior art is provided at four comers thereof with an upright rod A1 which is in fact composed of two upright rods fastened together by welding. In addition, the multilayered rack A is further provided with a plurality of cross rods A2 and wires A3 in conjunction with a plurality of retaining blocks A4 having an arcuate recess A41 which is fastened with an inner upright rod A11. Such a prior art multilayered rack as described above is defective in design in that it is not cost-effective, cannot be easily assembled, cannot be shipped economically, and is complicated in construction, as shown in FIGS. 1A and 1B.

As shown in FIG. 2, another multilayered rack B of the prior art is composed of a plurality of upright support rods B1, shelves B2, and retaining rings B21 which are fastened with the shelves B2 by welding, as shown in FIG. 2A. The upright support rods B1 are each provided in the outer surface thereof with a plurality of circular grooves B11. The shelves B2 are located by the retaining rings B21 in conjunction with the circular grooves B11. The prior art multilayered rack B described above is also complicated in construction, thereby making the multilayered rack B difficult to assemble. In addition, the assembly of the multilayered rack B requires welding work and the welded portions of the rack B are prone to detachment.

SUMMARY OF THE INVENTION

The primary objective of the present invention is therefore to provide a multilayered rack which is relatively simple in construction and can be thus assembled with ease and speed.

It is another objective of the present invention to provide a multilayered rack which is well built and durable.

It is still another objective of the present invention to provide a multilayered rack which is versatile in design so as to enhance the marketability of the multilayered rack.

The objectives, features, and functions of the present invention will be readily understood upon a thoughtful deliberation of the following detailed description of the present invention with reference to the accompanying drawings.

DETAILED DESCRIPTION OF THE INVENTION

Figure 1:
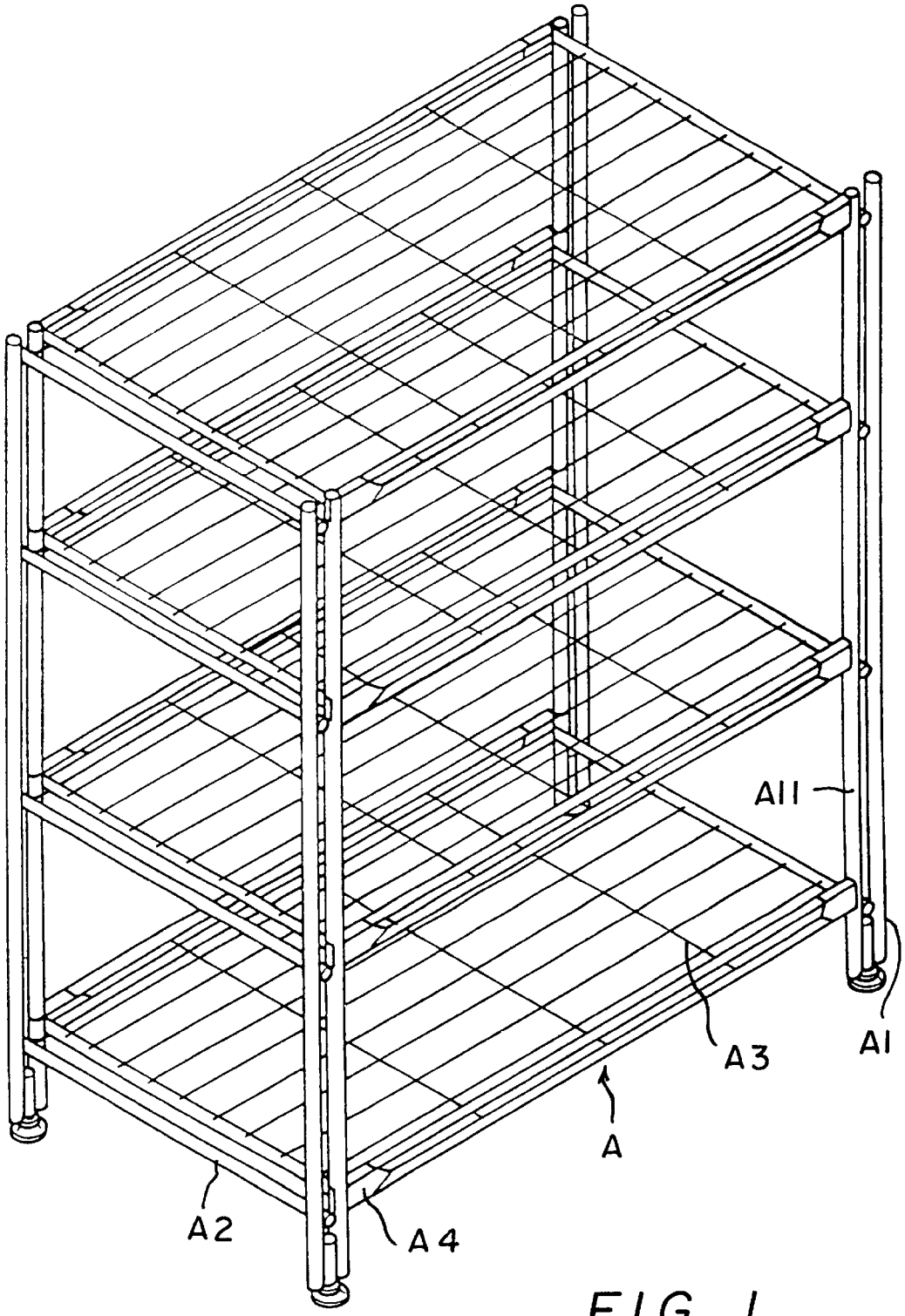
FIG. 1 PRIOR ART
FIG. 1 shows a perspective view of a multilayered rack of the prior art.
Figure 1A:
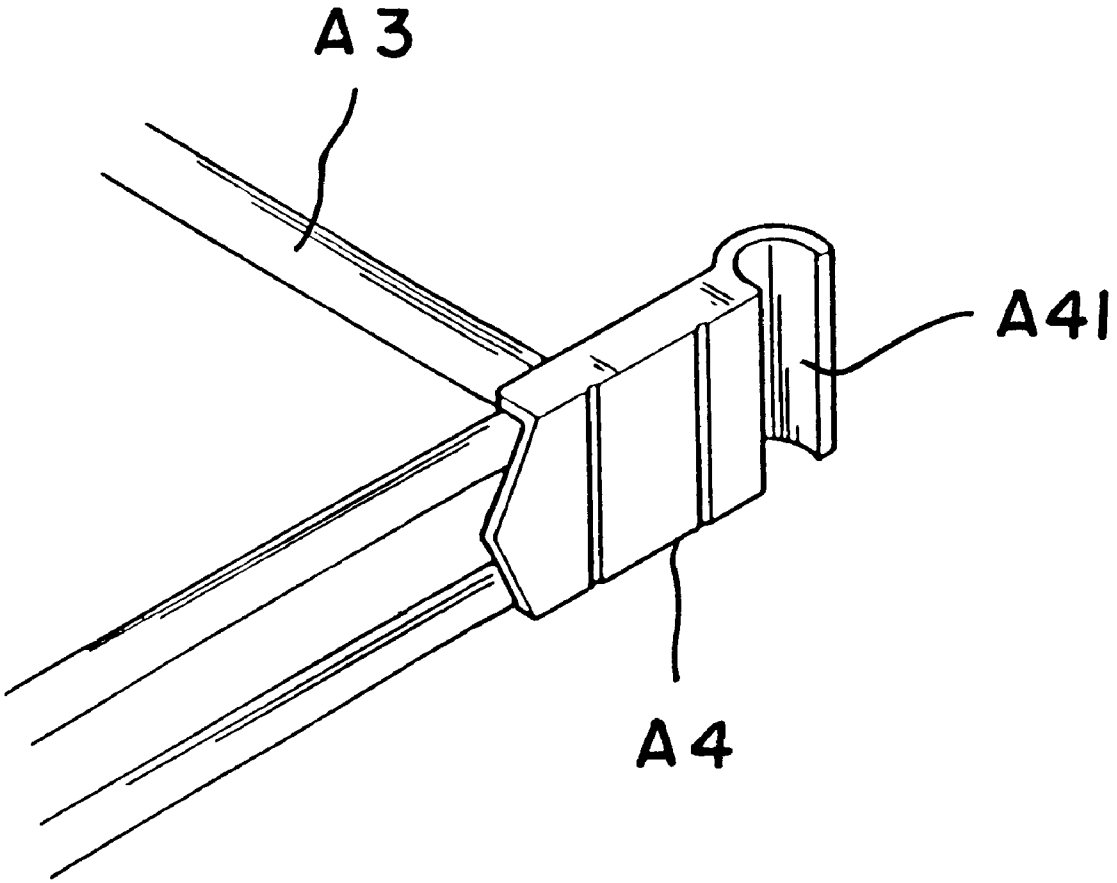
FIG. 1A PRIOR ART
FIG. 1A shows a partial schematic view of the prior art rack as shown in FIG. 1.
Figure 1B:
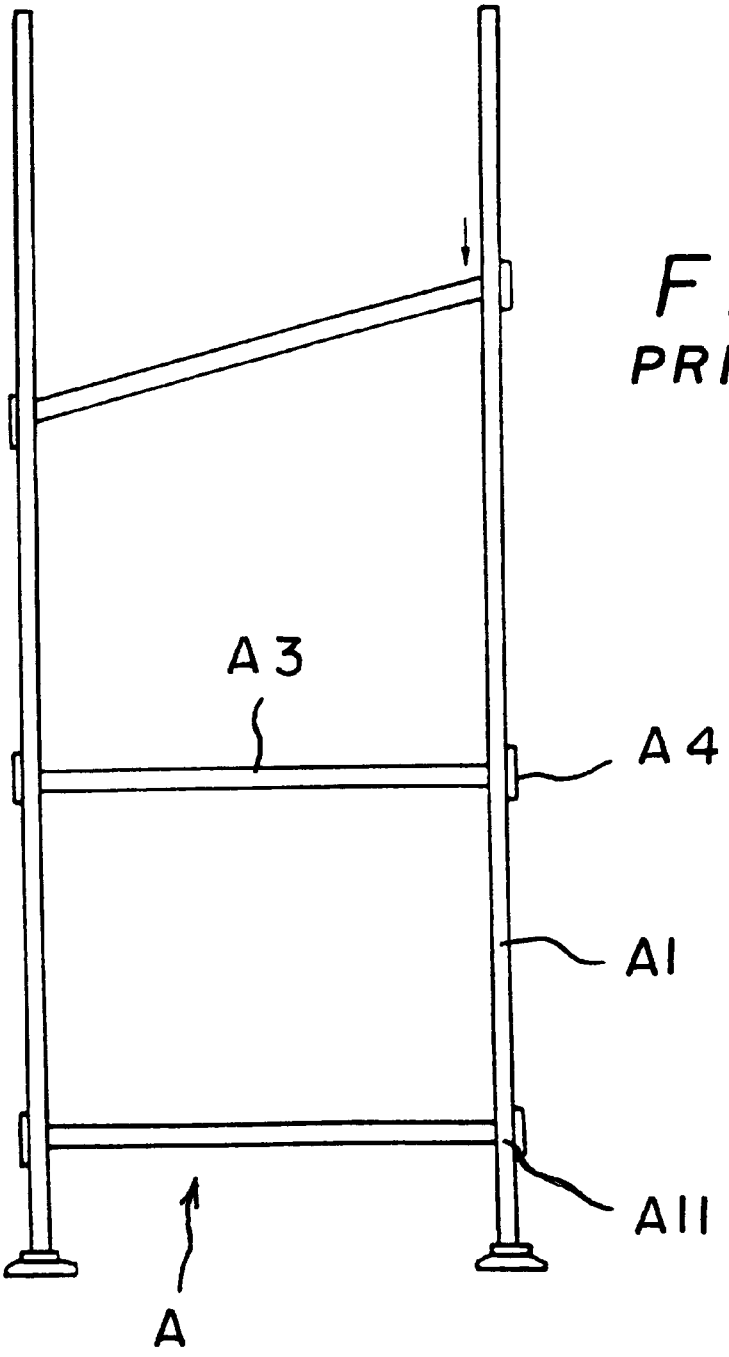
FIG. 1B PRIOR ART
FIG. 1B shows another partial schematic view of the prior art rack as shown in FIG. 1.
Figure 2:
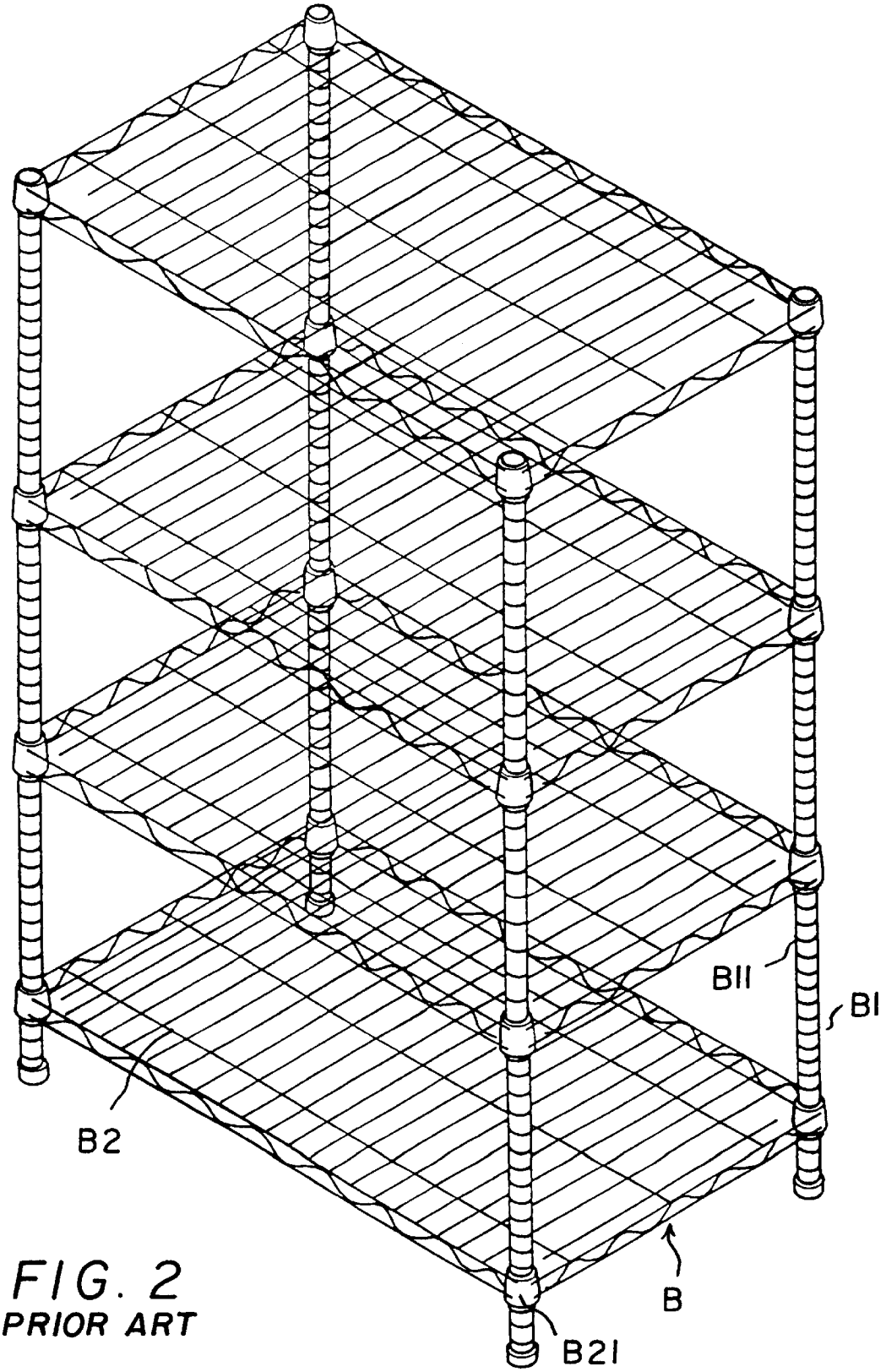
FIG. 2 PRIOR ART
FIG. 2 shows a perspective view of another multilayered rack of the prior art.
Figure 2A:
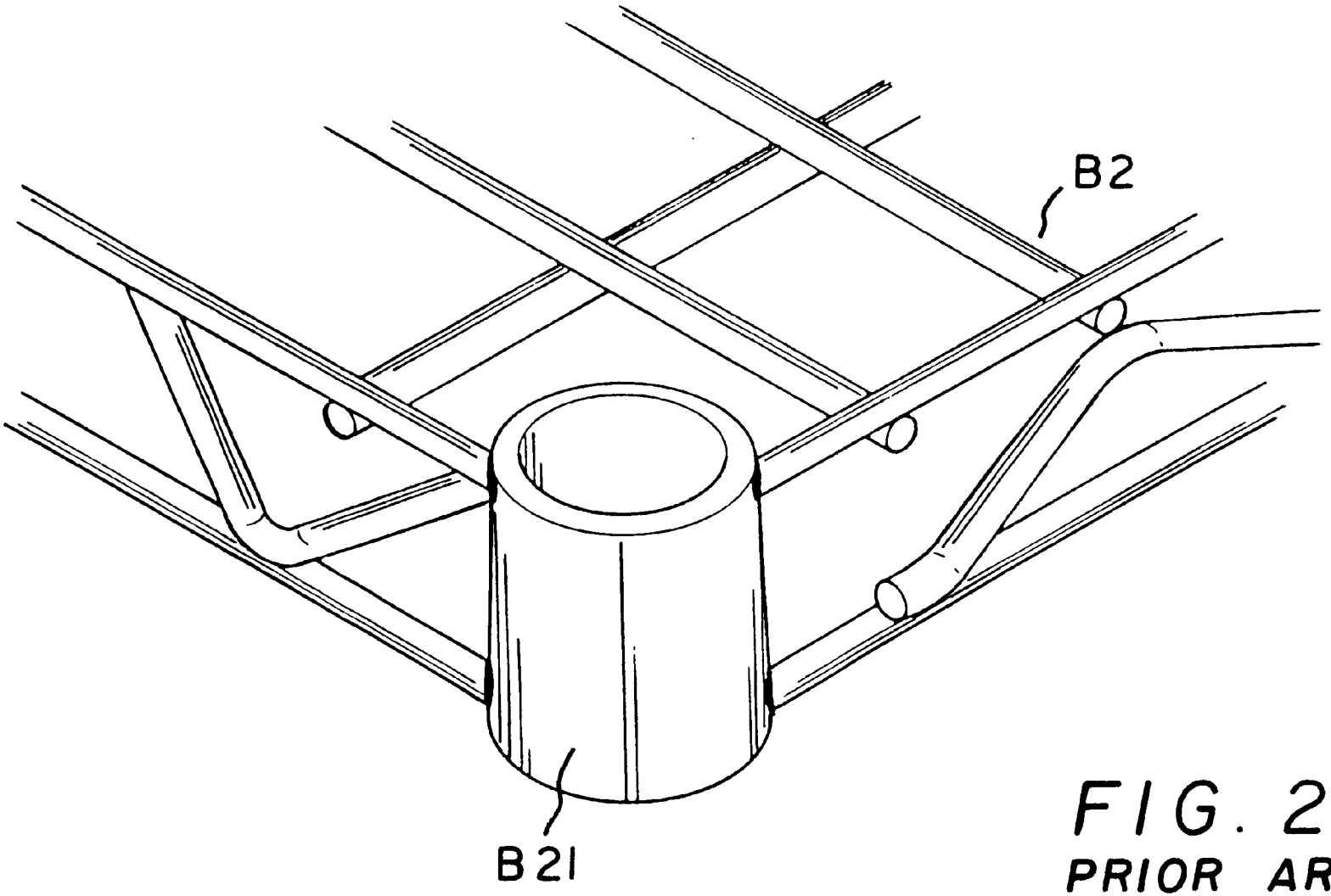
FIG. 2A PRIOR ART
FIG. 2A shows a partial schematic view of the prior art rack as shown in FIG. 2.
Figure 3:
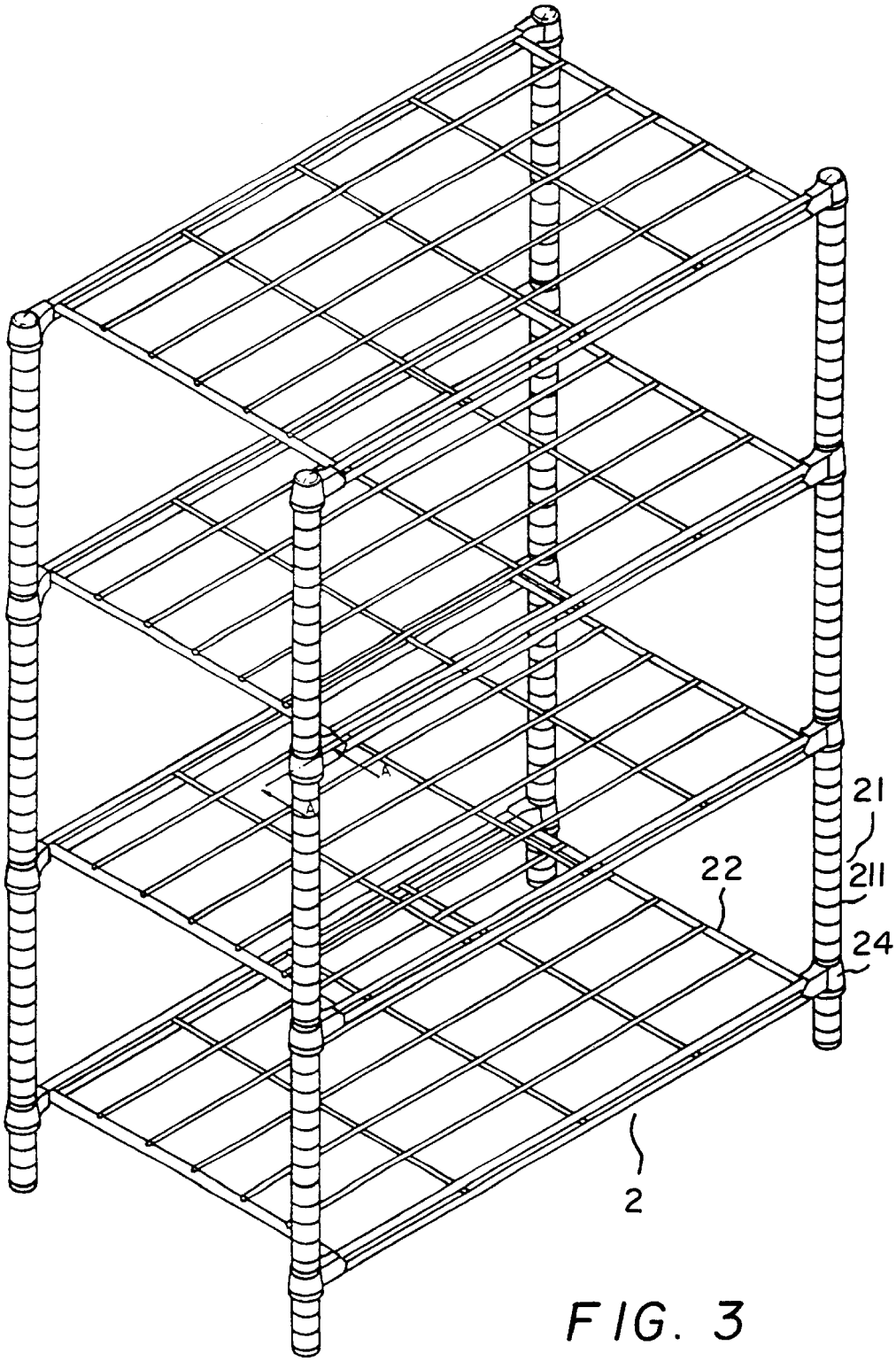
FIG. 3 shows a perspective view of a multilayered rack of the present invention.
Figure 3A:
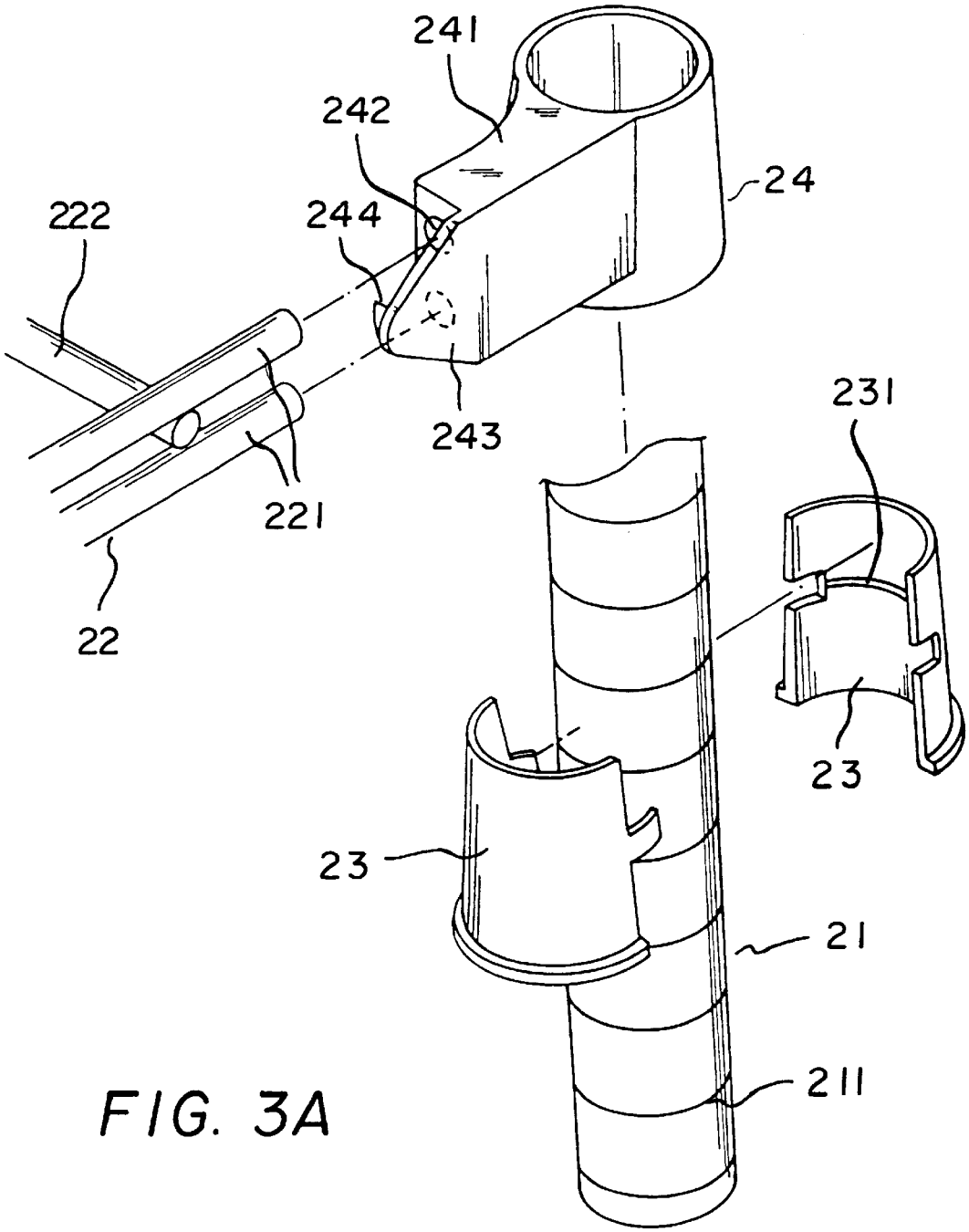
FIG. 3A shows a partial exploded view of the multilayered rack of the present invention.
Figure 3B:
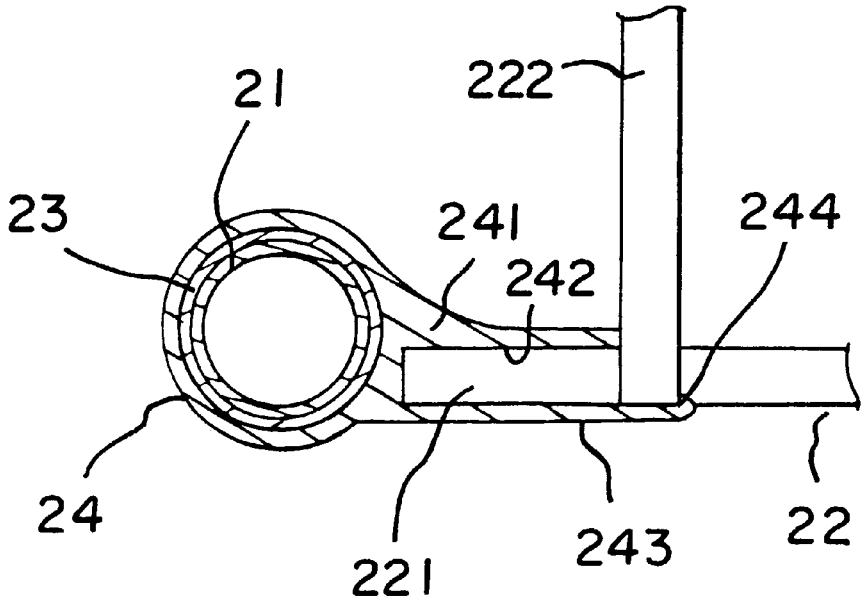
FIG. 3B shows a partial sectional view of the multilayered rack of the present invention.

As shown in FIGS. 3 and 3A, a multilayered rack assembly 2 according to the present invention is composed of four upright rods 21 and a plurality of shelves 22. The upright rods 21 are each provided in the outer wall thereof with a plurality of circular grooves 211 arranged at spaced intervals. The shelves 22 are fastened with the upright rods 21 by a plurality of fastening assemblies that each include a retaining ring 24 in conjunction with two arcuate pieces 23. The arcuate pieces 23 are symmetrical to each other and are each provided in the inner wall thereof with a locating rib 231. The shelves 22 are each provided at each of the four corners thereof with two insertion segments 221 and a cross rod 222 disposed at a right angle to the insertion segment 221. The retaining rings 24 are each provided with a fastening block 241 which is made integrally therewith and is provided with two insertion holes 242, a concealing portion 243, and an inverted hook 244. The shelves 22 are fastened with the retaining rings 24 such that the insertion segments 221 are inserted into the insertion holes 242 of the retaining rings 24 which are in turn fastened with the upright rods 21 in conjunction with two arcuate pieces 23. The cross rod 222 of the shelves 22 is secured by the inverted hook 244, as shown in FIG. 3B. The retaining ring 24 is sleeved onto the arcuate pieces 23 which are maintained imposition by the locating ribs 231 of the arcuate pieces 23 being retained in the selected circular groove 211 of the upright rod 21.

Figure 4:
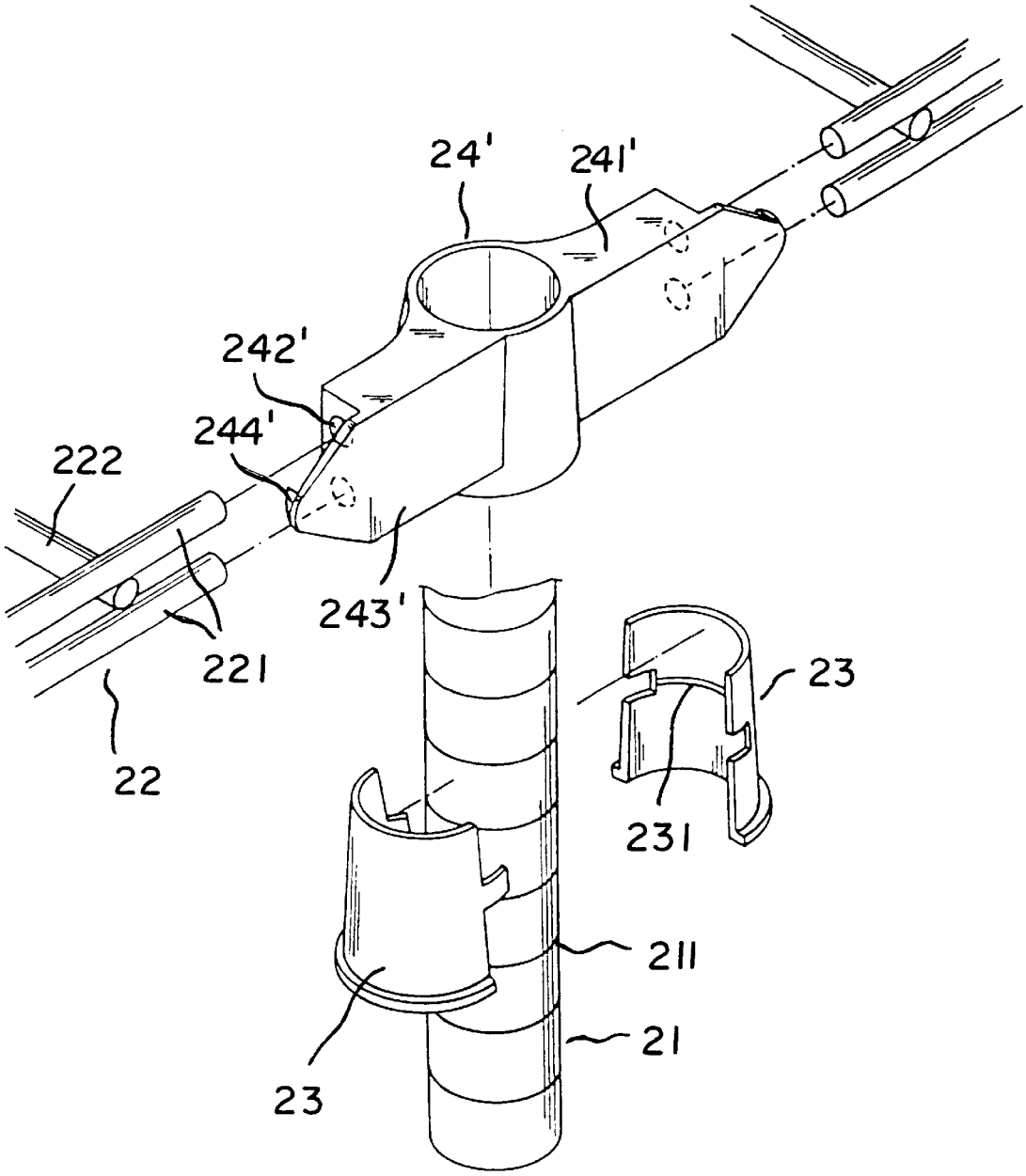
FIG. 4 shows a partial exploded view of a multilayered rack of another preferred embodiment of the present invention.

As shown in FIG. 4, the retaining ring 24' is provided with two fastening blocks 241' which are opposite in location to each other and are each provided with two insertion holes 242', a concealing portion 243', and an inverted hook 244'. The retaining rings 24' are used to fasten two multilayered racks together side by side.

Figure 5:
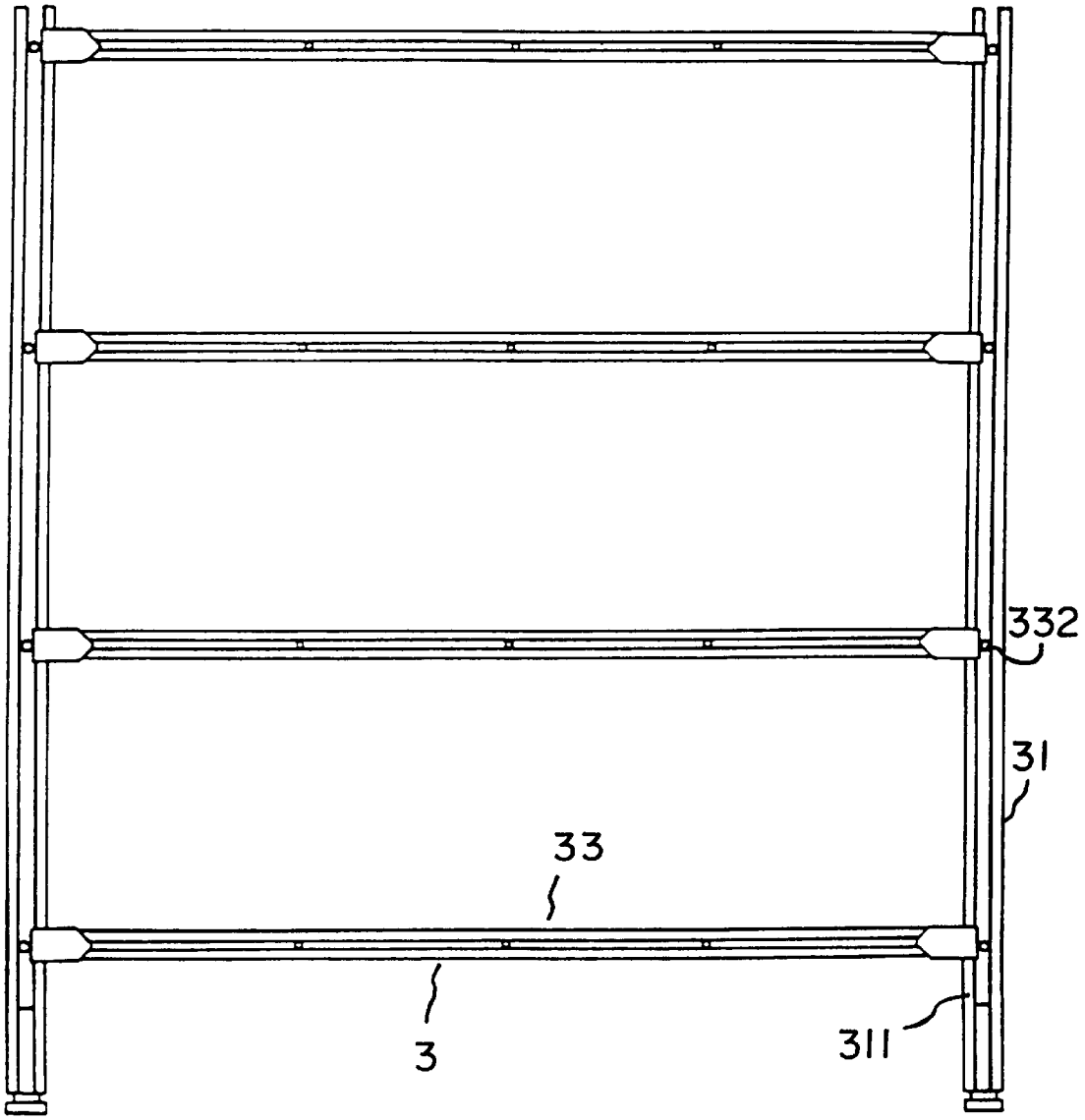
FIG. 5 shows a side view of the present invention in combination.
Figure 5A:
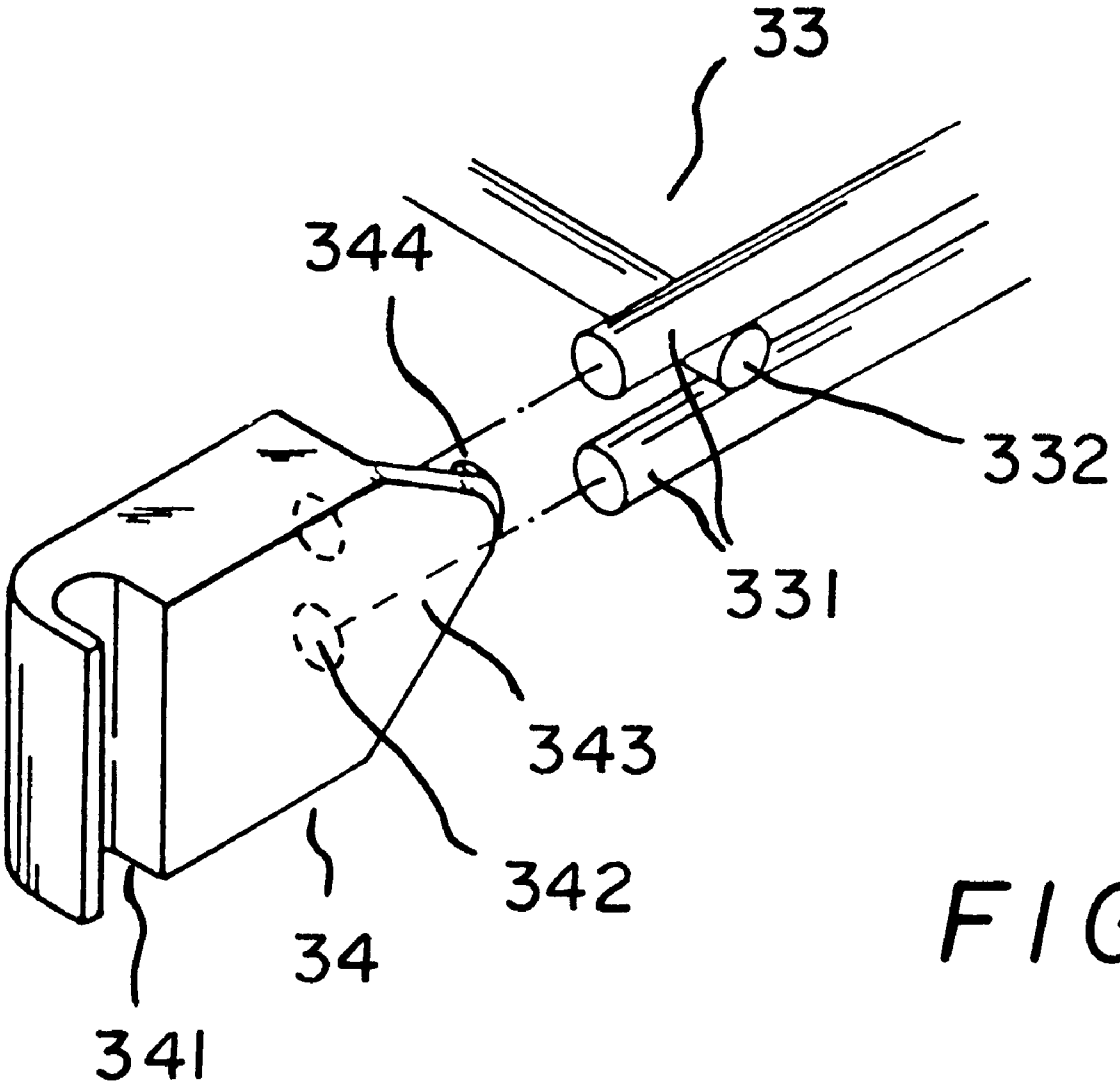
FIG. 5A shows a partial exploded view of the another preferred embodiment of the present invention.
Figure 5C:
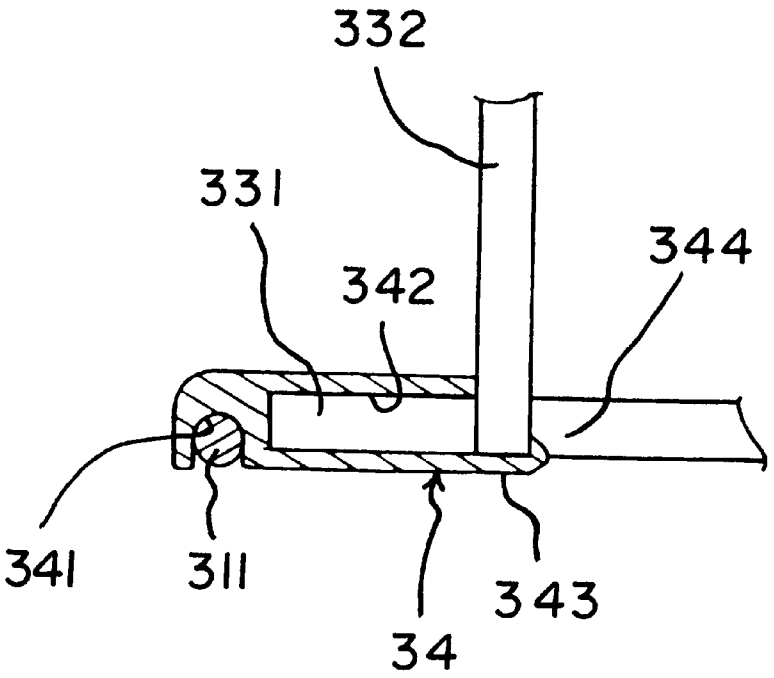
FIG. 5C shows a partial sectional view of the another preferred embodiment of the present invention.
Figure 5B:
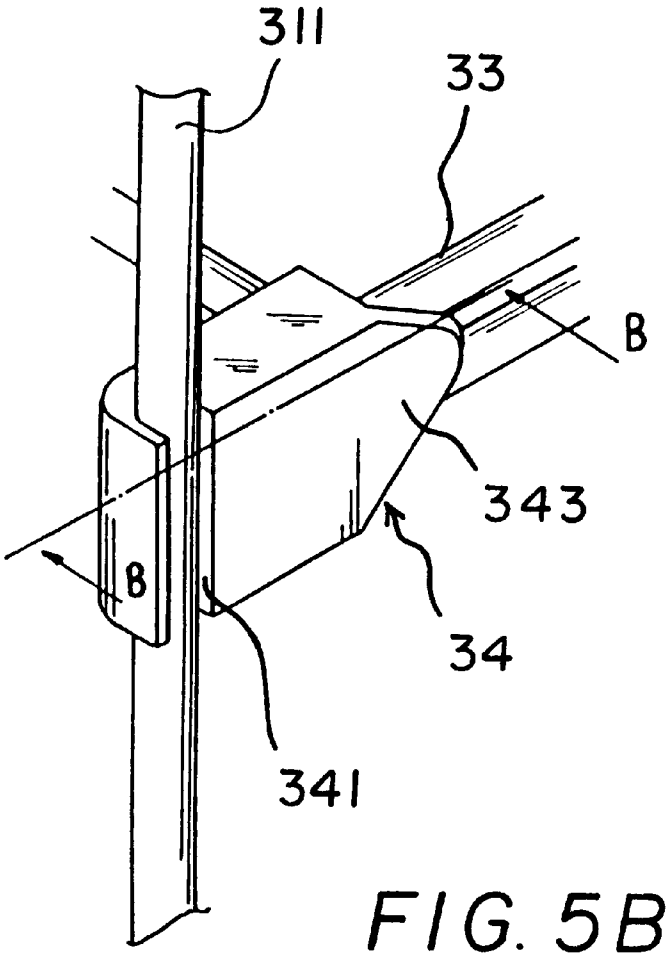
FIG. 5B shows a partial schematic view of the another preferred embodiment of the present invention.

As shown in FIG. 5 and FIG. 5A, a multilayered rack 3 of another p referred embodiment of the present invention is composed of a plurality of support rods 31, each of which is formed of two upright rod elements fastened together side by side by welding, and a plurality of cross rod 332. The shelves 33 are provided with insertion segments 331 which are inserted into the insertion holes 342 of the retaining block 34, as shown in FIG. 5A. The retaining block 34 is provided with a concealing portion 343 and an inverted hook 344 that directly fits between the insertion segments 331 without engaging the rear sides thereof opposite the sides facing the concealing portion 343. The retaining block 34 is provided at one end thereof with a retaining groove 341 in which the inner rod 311 of the upright rod 31 is retained, as shown in FIGS. 5B and 5C.

What is claimed is:

1. A multilayered rack assembly comprising:

a) four upright rods, each rod having a plurality of circular grooves formed in an outer wall thereof and spaced at intervals along the length of the rod;

b) a plurality of shelves, each shelf having four corners, each corner including a pair of insertion segments and a cross rod disposed at a right angle to the insertion segments;

c) a fastening assembly securing each corner of each shelf to an upright rod at a selected position on the rod, the fastening assembly including a pair of arcuate pieces and a retaining ring; and d) each arcuate piece having a locating rib engaged within a corresponding groove at the selected position, the retaining ring enclosing the arcuate pieces for securing the arcuate pieces to the rod in the selected position, the retaining ring including at least one fastening block extending outwardly therefrom, the block having a pair of insertion holes within which the pair of insertion segments are inserted, an inverted hook engaged around the cross rod, and a concealing portion concealing the insertion holes and inverted hook.

2. The multilayered rack assembly of claim 1 wherein each retaining ring includes a pair of fastening blocks extending outwardly therefrom in opposite directions.

3. A multilayered rack assembly comprising:

a) four support rods, each support rod including at least one upright rod element;

b) a plurality of shelves, each shelf having four corners, each corner including a pair of insertion segments and a cross rod disposed at a right angle to the insertion segments;

c) a retaining block securing each corner of each shelf to a support rod, the retaining block is in the form of a body having a pair of insertion holes formed therein and within which the pair of insertion segments are inserted, an inverted hook extending around and directly engaging an end of the cross rod to secure the end to the block, a retaining groove receiving at least one upright rod element, a concealing portion concealing the insertion holes, said concealing portion extending beyond said insertion holes in a direction away from said groove and terminating at said inverted hook, said hook extending toward said end of said cross rod away from said concealing portion and fitting directly between said insertion segments without engaging the insertion segments on the sides thereof opposite to the sides facing the concealing portion.

* * * * *